US006597093B2

(12) United States Patent
Yang

(10) Patent No.: US 6,597,093 B2
(45) Date of Patent: Jul. 22, 2003

(54) CATHODE RAY TUBE WITH A FOCUS MASK WHEREIN A CAP LAYER FORMED ON THE INSULATING MATERIAL

(75) Inventor: Liyou Yang, Plainsboro, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 399 days.

(21) Appl. No.: 09/737,405

(22) Filed: Dec. 15, 2000

(65) Prior Publication Data

US 2002/0074922 A1 Jun. 20, 2002

(51) Int. Cl.[7] ..... H01J 29/80

(52) U.S. Cl. ..... 313/402; 313/407; 313/408; 445/37

(58) Field of Search ..... 313/402, 403, 313/408, 355, 407, 414, 409, 479; 445/37, 67, 68

(56) References Cited

U.S. PATENT DOCUMENTS 3,668,002 A * 6/1972 Tadao Okabe ..... 427/124
5,594,300 A * 1/1997 Nosker et al. ..... 313/402
5,613,889 A * 3/1997 Nosker et al. ..... 445/37
5,625,251 A * 4/1997 Nosker et al. ..... 313/403
5,629,051 A * 5/1997 Poliniak ..... 427/475
5,644,192 A * 7/1997 Ragland, Jr. ..... 313/402
5,646,478 A * 7/1997 Nosker et al. ..... 313/402
5,647,653 A * 7/1997 Cherukuri ..... 313/402
5,952,774 A * 9/1999 Diven et al. ..... 313/402
6,084,342 A * 7/2000 Ragland, Jr. ..... 313/407
6,157,121 A * 12/2000 Ragland et al. ..... 313/403

* cited by examiner

*Primary Examiner*—Jay Patidar
(74) *Attorney, Agent, or Firm*—Joseph S. Tripoli; Joseph J. Laks; Carlos M. Herrera

(57) ABSTRACT

A color cathode-ray tube (CRT) having an evacuated envelope with an electron gun therein for generating an electron beam is disclosed. The envelope further includes a faceplate panel having a luminescent screen with phosphor lines on an interior surface thereof. A focus mask, having a plurality of spaced-apart first conductive lines, is located adjacent to an effective picture area of the screen. The spacing between the first conductive lines defines a plurality of slots substantially parallel to the phosphor lines on the screen. Each of the first conductive lines has a substantially continuous insulating material layer formed on a screen facing side thereof. A plurality of second conductive lines are oriented substantially perpendicular to the plurality of first conductive lines and are bonded thereto by the insulating material layer. A cap layer is formed over the plurality of second conductive lines and the insulating material. The cap layer is a semiconducting layer that is used to prevent charge accumulation on the insulating material layer.

10 Claims, 4 Drawing Sheets

CATHODE RAY TUBE WITH A FOCUS MASK WHEREIN A CAP LAYER FORMED ON THE INSULATING MATERIAL

BACKGROUND OF THE INVENTION

1. Field of the Invention

This invention relates to a color cathode-ray tube (CRT) and, more particularly to a color CRT including a focus mask.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color-emitting phosphors (e.g., green, blue, red) formed thereon. The aperture mask functions to direct electron beams generated in the electron gun toward appropriate color emitting phosphors on the screen of the CRT tube.

The aperture mask may be a focus mask. Focus masks typically comprise two sets of conductive lines (or wires) that are arranged orthogonal to each other, to form an array of openings. Different voltages are applied to the two sets of conductive lines so as to create multipole focusing lenses in each opening of the mask. The multipole focusing lenses are used to direct the electron beams toward the color-emitting phosphors on the screen of the CRT tube.

One type of focus mask is a tensioned focus mask, wherein at least one of the two sets of conductive lines is under tension. Typically, for tensioned focus masks, the vertical set of conductive lines is under tension, with the horizontal set of conductive lines overlying such vertical tensioned lines.

Where the two sets of conductive lines overlap, such conductive lines are typically attached at their crossing points (junctions) by an insulating material. When the different voltages are applied between the two sets of conductive lines of the mask, to create the multipole focusing lenses in the openings thereof, high voltage (HV) flashover may occur at one or more junctions. HV flashover is the discharge of an electrical charge across the insulating material separating the two sets of conductive lines. HV flashover is undesirable because it may cause an electrical short circuit between the two sets of conductive lines leading to the subsequent failure of the focus mask.

When the electron beams from the electron gun are directed toward the color-emitting phosphors on the screen, the electron beams may cause the insulator material on the focus mask to accumulate charge. Such charge accumulation is undesirable because it may interfere with the ability of the focus mask to accurately direct the electron beams toward the color-emitting phosphors formed on the screen, as well as cause HV flashover between the conductive lines of the focus mask.

Thus, a need exists for suitable insulating materials that overcome the above-mentioned drawbacks.

SUMMARY OF THE INVENTION

The present invention relates to a color cathode-ray tube (CRT) having an evacuated envelope with an electron gun therein for generating an electron beam. The envelope further includes a faceplate panel having a luminescent screen with phosphor lines on an interior surface thereof. A focus mask, having a plurality of spaced-apart first conductive lines, is located adjacent to an effective picture area of the screen. The spacing between the first conductive lines defines a plurality of slots substantially parallel to the phosphor lines on the screen. Each of the first conductive lines has a substantially continuous insulating material layer formed on a surface thereof. A plurality of second conductive lines are oriented substantially perpendicular to the plurality of first conductive lines and are bonded thereto by the insulating material layer. A cap layer is formed over the plurality of second conductive lines and the insulating material. The cap layer is a semiconducting layer that is used to prevent charge accumulation on the insulating material layer.

BRIEF DESCRIPTION OF THE DRAWINGS

The invention will now be described in greater detail, with relation to the accompanying drawing, in which.

DETAILED DESCRIPTION OF THE PREFERRED EMBODIMENT

Figure 1:
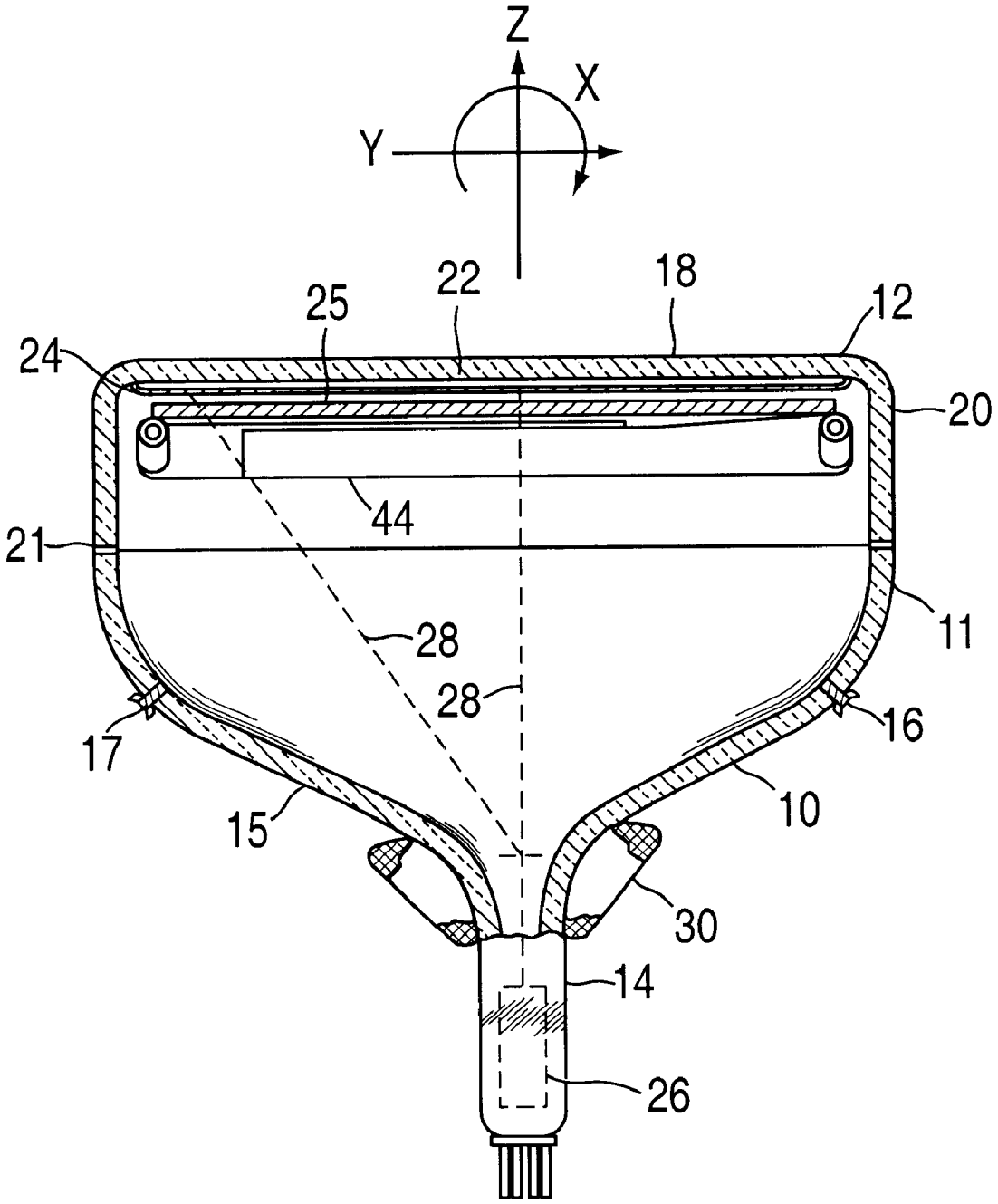
FIG. 1 is a plan view, partly in axial section, of a color cathode-ray tube (CRT) including a tension focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, a first anode button 16 to the neck 14. A second anode button 17, located opposite the first anode button 16, is not contacted by the conductive coating.

The faceplate panel 12 comprises a viewing faceplate 18 and a peripheral flange or sidewall 20 that is sealed to the funnel 15 by a glass frit 21. A three-color luminescent phosphor screen 22 is carrried by the inner surface of the faceplate 18. The screen 22 is a line screen, shown in detail in FIG. 5, that includes a multiplicity of screen elements comprised of red-emitting, green-emitting, and blue-emitting phosphor lines, R, G, and B, respectively, arranged in triads, each triad including a phosphor line of each of the three colors. Preferably, a light absorbing matrix 23 separates the phosphor lines. A thin conductive layer 24, preferably made of aluminum, overlies the screen 22 and provides means for applying a uniform first anode potential to the screen as well as for reflecting light, emitted from the phosphor elements, through the faceplate 18.

A cylindrical multi-aperture color selection electrode, or tension focus mask 25, is removably mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the tension focus mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams to magnetic fields that cause the beams to scan a horizontal and vertical rectangular raster across the screen 22.

The tension focus mask 25 is formed, preferably, from a thin rectangular sheet of about 0.05 mm (2 mil) thick low carbon steel (about 0.005% carbon by weight). Suitable materials for the tension focus mask 25 may include high expansion, low carbon steels having a coefficient of thermal expansion (COE) within a range of about $120–160\times10^{-7}/°$ C.; intermediate expansion alloys such as, iron-cobalt-nickel (e.g., KOVAR™) having a coefficient of thermal expansion within a range of about $40–60\times10^{-7}/°$ C.; as well as low expansion alloys such as, iron-nickel (e.g., INVAR™) having a coefficient of thermal expansion within a range of about $9–30\times10^{-7}/°$ C.

Figure 2:
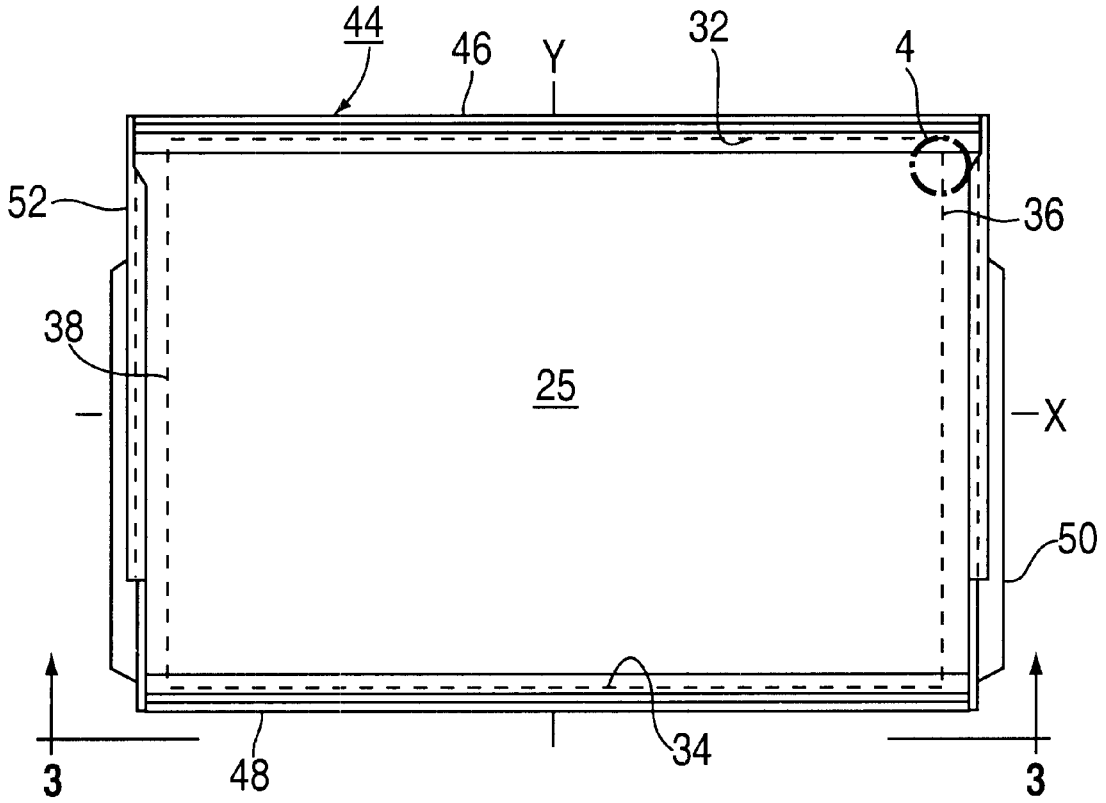
FIG. 2 is a plan view of the tension focus mask-frame assembly of FIG. 1.

As shown in FIG. 2, the tension focus mask 25 includes two long sides 32, 34 and two short sides 36, 38. The two long sides 32, 34 of the tension focus mask 25 are parallel with the central major axis, X, of the CRT while the two short sides 36, 38 are parallel with the central minor axis, Y, of the CRT.

Figure 4:
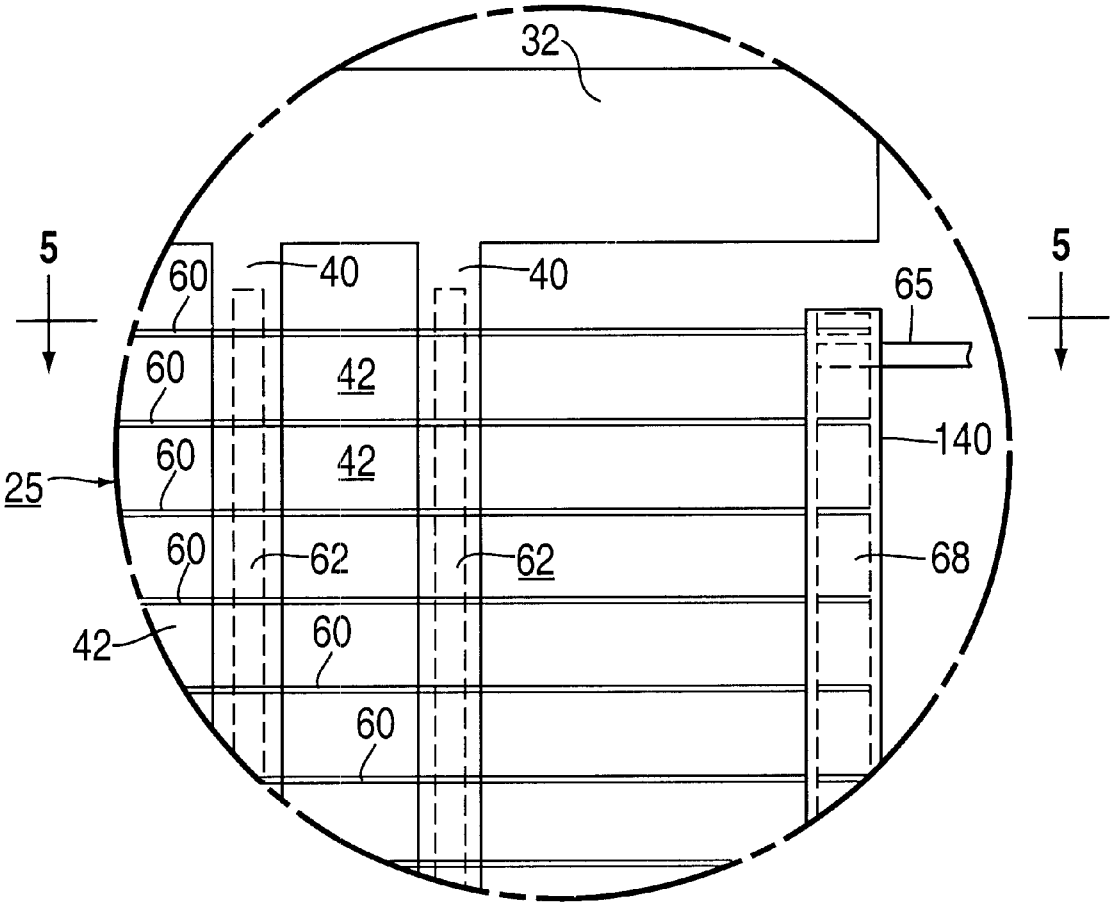
FIG. 4 is an enlarged section of the tension focus mask shown within the circle 4 of FIG. 2.

The tension focus mask 25 (shown schematically by the dashed lines in FIG. 2) includes an apertured portion that is adjacent to and overlies an effective picture area of the screen 22. Referring to FIG. 4, the tension focus mask 25 includes a plurality of first metal strands 40 (conductive lines), each having a transverse dimension, or width, of about 0.3 mm to about 0.5 mm (12–20 mils) separated by substantially equally spaced slots 42, each having a width of about 0.27 mm to about 0.43 mm (11–16 mils) that parallel the minor axis, Y, of the CRT and the phosphor lines of the screen 22. For a color CRT having a diagonal dimension of 68 cm, the first metal strands have widths in a range of about 0.3 mm to about 0.38 mm (12–14.5 mils) and a slot 42 width of about 0.27 mm to about 0.33 mm (11–13.3 mils). In a color CRT having a diagonal dimension of 68 cm (27 V), there are about 760 of the first metal strands 40. Each of the slots 42 extends from one long side 32 of the mask to the other long side 34 thereof (not shown in FIG. 4).

Figure 3:
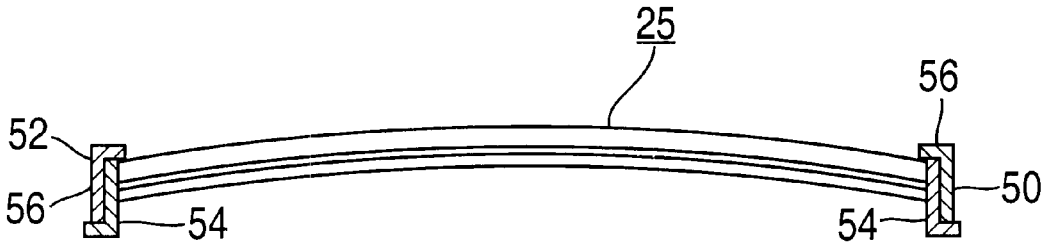
FIG. 3 is a front view of the mask-frame assembly taken along line 3—3 of FIG. 2.

A frame 44, for the tension focus mask 25, is shown in FIGS. 1–3, and includes four major members, two torsion tubes or curved members 46, 48 and two tension arms or straight members 50, 52. The two curved members 46, 48 are parallel to the major axis, X, and each other.

As shown in FIG. 3, each of the straight members 50, 52 includes two overlapped partial members or parts 54, 56, each part having an L-shaped cross-section. The overlapped parts 54, 56 are welded together where they are overlapped. An end of each of the parts 54, 56 is attached to an end of one of the curved members 46, 48. The curvature of the curved members 46, 48 matches the cylindrical curvature of the tension focus mask 25. The long sides 32, 34 of the tension focus mask 25 are welded between the two curved members 46, 48, which provides the necessary tension to the mask. Before welding the long sides 32, 34 of the tension focus mask 25 to the frame 44, the mask material is pre-stressed and darkened by tensioning the mask material while heating it, in a controlled atmosphere of nitrogen and oxygen, at a temperature of about 500° C., for about 120 minutes. The frame 44 and the mask material, when welded together, comprise a tension mask assembly.

Figure 5:
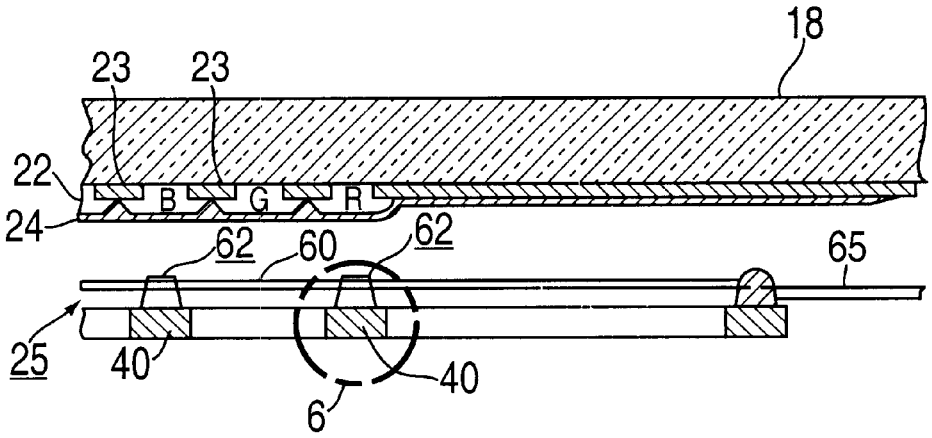
FIG. 5 is a view of the tension focus mask and the luminescent screen taken along lines 5—5 of FIG. 4.

With reference to FIGS. 4 and 5, a plurality of second metal strands (conductive lines) 60, each having a diameter of about 0.025 mm (1 mil), are disposed substantially perpendicular to the first metal strands 40 and are spaced therefrom by an insulator 62, formed on the screen-facing side of each of the first metal strands 40. The second metal strands 60 form cross members that facilitate the application of a second anode, or focusing, potential to the tension focus mask 25. Suitable materials for the second metal strands include iron-nickel alloys such as INVAR™ and/or carbon steels such as HyMu80 wire (commercially available from Carpenter Technology, Reading, Pa.).

The vertical spacing, or pitch, between adjacent second metal strands 60 is about 0.33 mm (13 mils) for a color CRT having a diagonal dimension of 68 cm (27 V). The relatively thin second metal strands 60 (as compared to the first metal strands 40) provide the essential focussing function of the tension focus mask 25, without adversely affecting the electron beam transmission thereof. The tension focus mask 25, described herein, provides a mask transmission, at the center of the screen 22, of about 40–45%, and requires that the second anode, or focussing, voltage, .V, applied to the second metal strands 60, differs from the first anode voltage applied to the first metal strands 40 by less than about 1 kV, for a first anode voltage of about 30 kV.

The insulators 62, shown in FIG. 4, are disposed substantially continuously on the screen-facing side of each of the first metal strands 40. The second metal strands 60 are bonded to the insulators 62 to electrically isolate the second metal strands 60 from the first metal strands 40.

The insulators 62 are formed of a suitable material that has a thermal expansion coefficient that is matched to the material of the tension focus mask 25. The material of the insulators should preferably have a relatively low melting temperature so that it may flow, cure, and adhere to both the first and second metal strands 40, 60 within a temperature range of about 450° C. to about 500° C. The insulator material should also preferably have a dielectric breakdown strength of about 40000 V/mm (1000 V/mil), with bulk and surface electrical resistivities of about $10^{11}$ ohm-cm and $10^{12}$ ohm/square, respectively. Additionally, the insulator material should be stable at temperatures used for sealing the CRT faceplate panel 12 to the funnel 15 (temperatures of about 450° C. to about 500° C.), as well as having adequate mechanical strength and elastic modulus, and be low outgassing during processing and operation for an extended period of time under electron beam bombardment.

Suitable insulator materials include silicate glasses such as lead-zinc borosilicate glasses, lead-zinc borosilicate glasses doped with transition metal oxides, as well as organosilicate materials.

A cap layer 65 is formed over the plurality of second metal strands 60 and the insulators 62. The cap layer 65 is a semiconducting layer that is used to prevent charge accumulation on the insulating material layer. The semiconducting cap layer 65 preferably has a sheet resistance within a range of about $10^{11}$ ohm/square to about $10^{14}$ ohm/square. The cap layer 65 preferably has a thickness within a range of about 100 Å to about 500 Å.

A suitable semiconducting material layer is silicon carbide. The silicon carbide may be a doped silicon carbide layer. The dopants increase the number of free carriers in the semiconducting material, thereby controlling conductivity thereof. Suitable dopants include Group III and Group V elements such as, for example, phosphorous (P), boron (B), aluminum (Al), and arsenic (As), among others.

The silicon carbide layer may be formed by applying an electric field (e.g., radio frequency (RF) power or a DC power) to a gas mixture comprising a silicon source and a carbon source, in for example, a plasma enhanced chemical vapor deposition (PECVD) system. Suitable silicon sources and/or carbon sources may include one or more compounds selected from methane ($CH_4$), silane ($SiH_4$), ethane ($C_2H_6$), disilane ($Si_2H_6$), fluoromethane ($CH_3F$), difluoromethane ($CH_2F_2$), trifluoromethane ($CHF_3$), and carbon tetrafluoride ($CF_4$), among others. Alternatively, organosilane compounds may be used for both the silicon source and the carbon source. Suitable organosilane compounds include, for example, methylsilane, dimethylsilane, trimethylsilane, tetramethylsilane, trisilamethane ($CH(SiH_3)_3$), disilamethane ($CH_2(SiH_3)_2$), and silamethane ($CH_3(SiH_3)$), among others.

Suitable dopant gases include phosphene ($PH_3$) diborane ($B_2H_6$), and trimethyl borane ($B(CH_3)$), among others.

In general, the following deposition process parameters can be used to form the silicon carbide layer using a PECVD system. The process parameters range from a temperature of about 150° C. to about 300° C., a pressure of about 0.1 torr to about 5 torr, a carbon source/silicon source gas flow ratio of between about 1% to about 30%, a dopant/silicon source gas flow ratio of about 0.2% to about 5%, a plasma power of about 10 mW/cm$^2$ to about 200 mW/cm$^2$. The above process parameters provide a deposition rate for the silicon carbide layer in a range of about 1 Å/sec to about 4 Å/sec. The parameters listed above may vary according to the particular source of materials and/or the deposition system used to form the silicon carbide layer.

Figure 6:
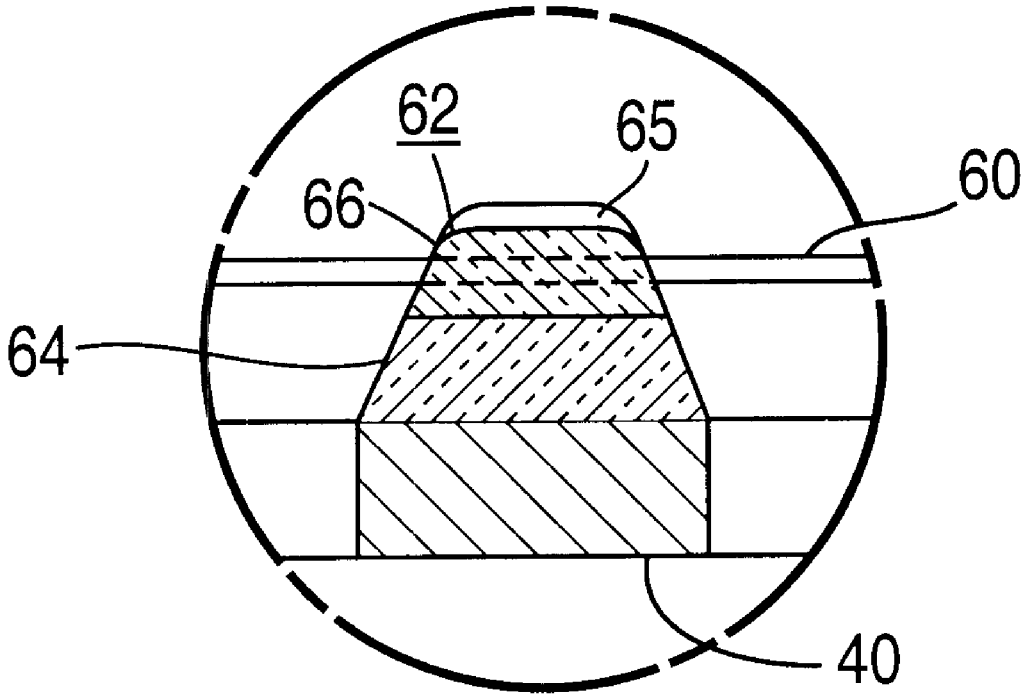
FIG. 6 is an enlarged view of a portion of the tension focus mask shown within the circle 6 of FIG. 5.

According to a preferred method of making the tension focus mask 25, and referring to FIG. 6, a first coating of the insulator 64 is provided, e.g., by spraying, onto the screen-facing side of the first metal strands 40. The first metal strands 40, in this example, are formed of a low expansion alloy, such as INVAR™, having a coefficient of thermal expansion within the range of $9–30\times10^{-7}$/° C. The first insulator coating 64, for example, may be a lead-zinc borosilicate glass such as SCC-11. The first coating of the insulator 64 typically has a thickness of about 0.05 mm to about 0.09 mm (2–3 mils).

The frame 44, including the coated first metal strands 40, is dried at room temperature. After drying, the first coating of the insulator material 64 is hardened (cured) by heating the frame 44 and the first metal strands 40, in an oven. The frame 44 is heated over a period of about 30 minutes to a temperature of about 300° C., and held at 300° C., for about 20 minutes. Then over a period of about 20 minutes the temperature of the oven is increased to about 460° C., and held at that temperature for one hour to melt and crystallize the first coating of the insulator material 64 on the first metal strands 40. The first insulator layer 64, after curing, will typically not remelt. The first coating of the insulator material 64 is typically dome-shaped and has a thickness in within a range of about 0.05 mm to about 0.09 mm (2–3.5 mils) across each of the first metal strands 40.

After the first coating of the insulator material 64 is hardened, a second coating of the insulator material 66 is applied over the first coating of the insulator material 64. The second coating of the insulator material 66 has the same composition as the first coating. The second coating of the insulator material 66 has a thickness of about 0.0125 mm to about 0.05 mm (0.5–2 mils).

Thereafter, the second metal strands 60 are applied to the frame 44, over the second coating of the insulator material 66, such that the second metal strands 60 are substantially perpendicular to the first metal strands 40. The second metal strands 60 are applied using a winding fixture (not shown) that accurately maintains a desired spacing of for example, about 0.33 mm (13 mils) between adjacent metal strands for a color CRT having a diagonal dimension of about 68 cm (27 V).

Alternatively, the second coating of the insulator material 66 may be applied over the first coating of the insulator material 64 and the second metal strands 60, after the winding operation.

The frame 44, including the winding fixture, is heated to a temperature of about 460° C. for about 30 minutes to bond the second metal strands 60 to the second coating of the insulator material 66.

Following curing, a semiconducting cap layer 65 is formed over the plurality of second metal strands 60 and the second coating of the insulator material 66. The semiconducting cap layer 65 is, for example, a n-type silicon carbide layer doped with phosphorous.

The semiconducting cap layer 65 has a thickness within a range of about 100 Å to about 500 Å. The silicon carbide semiconducting cap layer 65, for example, may be formed by reacting a gas mixture comprising methane ($CH_4$), silane ($SiH_4$), and phosphene ($PH_3$) in the presence of an electric field, according to the following conditions: a temperature of about 250° C., a pressure of about 0.5 torr, a power of about 25 mW/cm$^2$, a $CH_4/SiH_4$ flow ratio of about 15%, and a $PH_3/SiH_4$ flow ratio of about 1%.

After the silicon carbide semiconducting cap layer 65 is formed, electrical connections are made to the first and second strands 40, 60, and the tension focus mask 25 is inserted into a tube envelope.

What is claimed is:

1. A cathode-ray tube comprising an evacuated envelope having therein an electron gun for generating an electron beam, a faceplate panel having a luminescent screen with phosphor lines on an interior surface thereof, and a focus mask, wherein the focus mask includes a plurality of spaced-apart first conductive lines having an insulating material thereon, and a plurality of spaced-apart second conductive lines oriented substantially perpendicular to the plurality of spaced-apart first conductive lines, the plurality of spaced-apart second conductive lines being bonded to the insulating material, comprising:

a cap layer formed on the insulating material.

2. The cathode-ray tube of claim 1 wherein the cap layer is semiconducting.

3. The cathode-ray tube of claim 2 wherein the semiconducting cap layer is a silicon carbide layer.

4. The cathode-ray tube of claim 3 wherein the silicon carbide layer is doped with an element selected from the group consisting of phosphorous, arsenic, aluminum, and boron.

5. The cathode-ray tube of claim 1 wherein the cap layer has a sheet resistance within a range of about $10^{11}$ ohm/square to about $10^{14}$ ohm/square.

6. A method of manufacturing a cathode-ray tube comprising an evacuated envelope having therein an electron gun for generating at least one electron beam, a faceplate panel having a luminescent screen with phosphor lines on an interior surface thereof, and a focus mask, wherein the focus mask includes a plurality of spaced-apart first conductive lines having an insulating material thereon, and a plurality of spaced-apart second conductive lines oriented substantially perpendicular to the plurality of spaced-apart first conductive lines, the plurality of spaced-apart second conductive lines being bonded to the insulating material, comprising:

forming a cap layer on the insulating material.

7. The method of claim 6 wherein the cap layer is semiconducting.

8. The method of claim 7 wherein the semiconducting cap layer is a silicon carbide layer.

9. The method of claim 8 wherein the silicon carbide layer is doped with an element selected from the group consisting of phosphorous, arsenic, aluminum, and boron.

10. The method of claim 6 wherein the cap layer has a sheet resistance within a range of about $10^{11}$ ohm/square to about $10^{14}$ ohm/square.

* * * * *